US005476538A

United States Patent [19]

Nishio et al.

[11] Patent Number: 5,476,538

[45] Date of Patent: Dec. 19, 1995

[54] METHOD OF REMOVING AEROSOLS BY THE RADIATION EFFECT

[75] Inventors: Gunji Nishio; Junichi Takada; Mitsuo Naritomi; Mikio Murata; Hitoshi Abe, all of Ibaraki, Japan

[73] Assignee: Japan Atomic Energy Research Institute, Tokyo, Japan

[21] Appl. No.: 272,741

[22] Filed: Jul. 11, 1994

[30] Foreign Application Priority Data

Jul. 13, 1993 [JP] Japan ..... 5-173288

[51] Int. Cl.[6] ..... B03C 3/43

[52] U.S. Cl. ..... 95/70; 55/279; 95/78; 96/16; 96/66; 250/424; 422/4; 422/22

[58] Field of Search ..... 96/16, 66; 95/57, 95/70, 78; 55/279; 422/22, 24, 4, 122; 250/423 R, 424

[56] References Cited

U.S. PATENT DOCUMENTS

| | | | |
|---|---|---|---|
| 3,154,682 | 10/1964 | Hartz et al. | 96/16 X |
| 3,313,971 | 4/1967 | Nagy | 96/16 X |
| 3,744,216 | 7/1973 | Halloran | 96/16 |
| 3,798,879 | 3/1974 | Schmidt-Burbach et al. | 96/16 |
| 3,910,778 | 10/1975 | Shahgholi et al. | 96/16 |
| 4,574,004 | 3/1986 | Schmidt-Ott et al. | 55/279 X |
| 4,750,917 | 6/1988 | Fujii | 96/16 |
| 4,876,852 | 10/1989 | Abthoff et al. | 96/16 X |

FOREIGN PATENT DOCUMENTS

| | | | |
|---|---|---|---|
| 1039038 | 9/1958 | Germany | 96/16 |

*Primary Examiner*—Richard L. Chiesa
*Attorney, Agent, or Firm*—Banner & Allegretti, Ltd.

[57] ABSTRACT

The present invention is directed to a method of removing aerosols using a radiation effect. Specifically, the method applies a dc current in a cell between a porous electrode exposed to radiation and a porous electrode shielded from radiation; allows the aerosol-containing gas to flow in the cell from the exposed electrode to the shielded electrode and exposing the gas to radiation so that streams of positive and negative ions are formed by radiation-induced ionization; causes the positive and negative ions to collide with the aerosol particles in the cell to form charged aerosol particles; subsequently passes the charged aerosol particles through the shielded electrode so that the aerosol particles electrified with positive ions are deposited or trapped on the shielded electrode if the latter has a negative polarity or that the aerosol particles electrified with negative ions are deposited or trapped on the shielded electrode if the latter has a positive polarity; thereby generates charged aerosol particles of a single polarity in the area just downstream of the shielded electrode as a result of collisions with large quantities of ions that have been electrified to the same single polarity as that of the shielded electrode; and then either deposits the charged aerosol particles of a single polarity on the surface of a substance by an electrostatic force or traps the charged aerosol particles of a single polarity on an electrode or a filter. The method is capable of removing the aerosol particles with an extremely high efficiency.

1 Claim, 7 Drawing Sheets

METHOD OF REMOVING AEROSOLS BY THE RADIATION EFFECT

BACKGROUND OF THE INVENTION

This invention relates to a method of removing aerosols by the radiation effect, in which an aerosol-containing ambient gas is exposed to a radiation so that the gas is ionized to pairs of positive and negative ions and in which either positive or negative ions are allowed to collide with aerosol particles by Brownian motion so that the aerosol particles are charged to a single polarity and in which the thus charged aerosol particles are removed by a suitable technique such as deposition on the surface of a substance by image force or trapping on an electrode of the opposite polarity or filter by Image force.

It is well known that when an ambient gas is exposed to a radiation, electrons are knocked out of the molecules of the gas to generate ionic pairs, with the positive ion being provided by the molecular ion and the negative ton by electrons.

The present inventors conducted an experiment in which an aerosol was irradiated with gamma rays to generate a charged aerosol, which was then passed through a screen electrode shielded from radiations. As it turned out, the percent deposition of particles on the electrodes with a size of 0.4 μm and more was better than the percent trapping by a HEPA (high-efficiency particulate air) filter. It was also found that when the charged aerosol was passed through both the porous electrodes and the HEPA filter, the electrostatic force of the charged particles contributed to improve the trapping efficiency by approximately 10,000 times as high as the inherent efficiency of the filter. The HEPA filter is composed of extremely fine glass fibers and capable of trapping particles not larger than 10 μm with a very high efficiency of at least 99.97%. The term "image force" as used herein means an electrostatic force that is provided by either positively or negatively charged aerosol particles approaching an uncharged substance in such a way that the surface of the latter is polarized to the opposite polarity, thereby trapping the aerosol particles on that surface.

Since the irradiation with gamma-rays and electron beams finds a wide range of applicability, the performance data set forth in the preceeding paragraph have potentially a far-reaching effect from the viewpoint of removing aerosols on an industrial scale. For example, the technique under consideration is applicable not only in cleanrooms used in the semiconductor and other electronic industries and biotechnological industries; it is also applicable to the treatment of aerosols of high concentration and, hence, it can be used in the treatment of flue gases from thermal power plants and general engineering practices. Further, experiments have shown that in the nuclear field, the technique holds promise for use not only in the incineration of burnable wastes of low radioactivity level but also in incinerators of medium-level wastes which have heretofore been difficult to incinerate.

(a) Producing charged aerosols by corona discharge

Charged aerosols are typically produced by corona discharge. In corona discharge, an intense dc electric field is applied between a plate electrode and a linear electrode so that discharge is caused to take place within the small region around tile linear electrode, thereby ionizing the ambient gas. If a negative potential is applied to the linear electrode, the positive ions will move toward the linear electrode whereas the electrons will move toward the plate (cylindrical) electrode.

The strength of potential decreases sharply with the increasing distance from the linear electrode and, hence, the velocity of electrons decreases as they come closer to the plate electrode and Brownian motion causes the electrons to collide with the particles of the ambient gas, thereby forming negative ions. The region of discharge is small and, therefore, if tile aerosol to be treated is introduced into an electric field, the aerosol particles will collide with negative ions to be charged negatively. For successful performance, corona discharge needs a strong electric field and involves difficulty in constructing large equipment. Therefore, the corona discharge technique is essentially unsuitable for large-scale treatment of aerosols.

(b) Production of unipolar aerosols by alpha-particle charging to a single polarity A study has been reported on the production of monopolar aerosols using alpha particles. In this method, an electrode is placed both on the bottom and in the upper part of a small vessel about 10 cm high and a weak dc electric field is applied between the two electrodes. An alpha-particle source is mounted on the electrode on the bottom of the vessel. Upon irradiation with alpha particles, ionization occurs to produce ionic pairs consisting of positive and negative ions and, depending on the polarities of the electrodes, either positive or negative ions will move outside the range of alpha particles (which is about 4 cm) and mix with the aerosol flowing in the upper part of the vessel, whereby the aerosol particles are charged to a single polarity. In the reported study, the monopolar aerosol was passed through a filter to determine the effect of image force empirically and the image force of charged particles with respect to the filter was analyzed theoretically.

The use of alpha particles for charging to a single polarity depends on diffusive charging for electrification and hence is an effective method for charging submicron particles. "Diffusive charging" is a phenomenon in which aerosol particles are charged by the collision between those particles and the monopolar ions due to Brownian motion. A problem with the approach of the alpha charging method is that the short range of alpha particles introduces difficulty in constructing large equipment, thereby making the procedure unsuitable for large-scale treatment of aerosols.

(c) Charged filters (for trapping by the electrostatic effect)

For efficient trapping of submicron particles with filters, one may reduce the size of fibers in the filter medium but then the pressure loss that occurs in the filter will increase so much as to reduce the throughput to an impractical low level. Under the circumstances, studies have been conducted to trap aerosols on filters by making use of inductive force and charged filters suittable for use to that end have been commercialized.

The term "inductive force" as used herein means a force that acts on uncharged aerosol particles approaching a substance charged to a single polarity in such a way that the particles are polarized to the opposite polarity, whereby the latter are trapped on the surface of the charged substance. Charged filters have large fiber sizes, so if aerosol particles deposit on the filter, the charges in it are neutralized to cause a marked drop in trapping efficiency, which has been a serious problem with the prior art.

SUMMARY OF THE INVENTION

The present inventors conducted "A Study on the Aerosol Ionizing Effect of Radiations" with a view to achieving marked improvements in the efficiency of deposition or trapping of submicron aerosol particles. As a result, the inventors found that aerosols could be trapped with high efficiency by exposure to radiations.

When exposed to a radiation, an ambient gas is ionized to ionic pairs consisting of positive and negative ions. If each ionic pair is separated into a positive and a negative ion and if either ionic species is caused to act on the aerosol, ions of that species will electrify the aerosol by the diffusive charging effect, thereby generating aerosol particles charged to a single polarity. The inventors revealed experimentally that the charged aerosol particles could either be deposited on the surface of a certain substance as attracted by the strong "image force" or be trapped on filters with high removal efficiency. In the experiment, aerosol particles charged to a single polarity by exposure to a radiation were permitted to flow through a screen electrode of the opposite polarity shielded from radiation and an extremely high percent deposition could be obtained by the electrode itself that was comparable to the efficiency of trapping on filters.

It should also be noted that when charged aerosols passing through screen electrodes were treated with a HEPA filter, the removal efficiency was about 1,000–10,000 times as high as the percent trapping by conventional filters.

This method is anticipated to have a far-reaching effect from the viewpoint of aerosol removal on an industrial scale. In the nuclear field, the method may potentially be used in the treatment of flue gases from incinerators of radioactive burnable wastes; in the field of environmental preservation, the method may be used in the treatment of flue gases from thermal power plants; and in the field of air purification technology, the method may be applied to cleanrooms in the semiconductor fabricating industry and in the biotechnological industry.

The method of the present invention comprises the steps of:

exposing an aerosol-containing ambient gas to a radiation so that the gas is ionized to produce ionic pairs consisting of positive and negative ions;

separating each ionic pair to a positive and a negative species;

causing either one of the two ionic species to act on the aerosol to be removed, so that the ionic species is caused to collide (for diffusive charging) with the aerosol, thereby generating aerosol particles charged to a single polarity; and depositing the monopolar aerosol particles on the surface of a certain substance by the image force or passing said particles through an electrode of the opposite polarity or HEPA filter by the image force, whereby the aerosol particles are removed with an extremely high deposition or trapping efficiency.

DETAILED DESCRIPTION OF THE INVENTION

Figure 1:
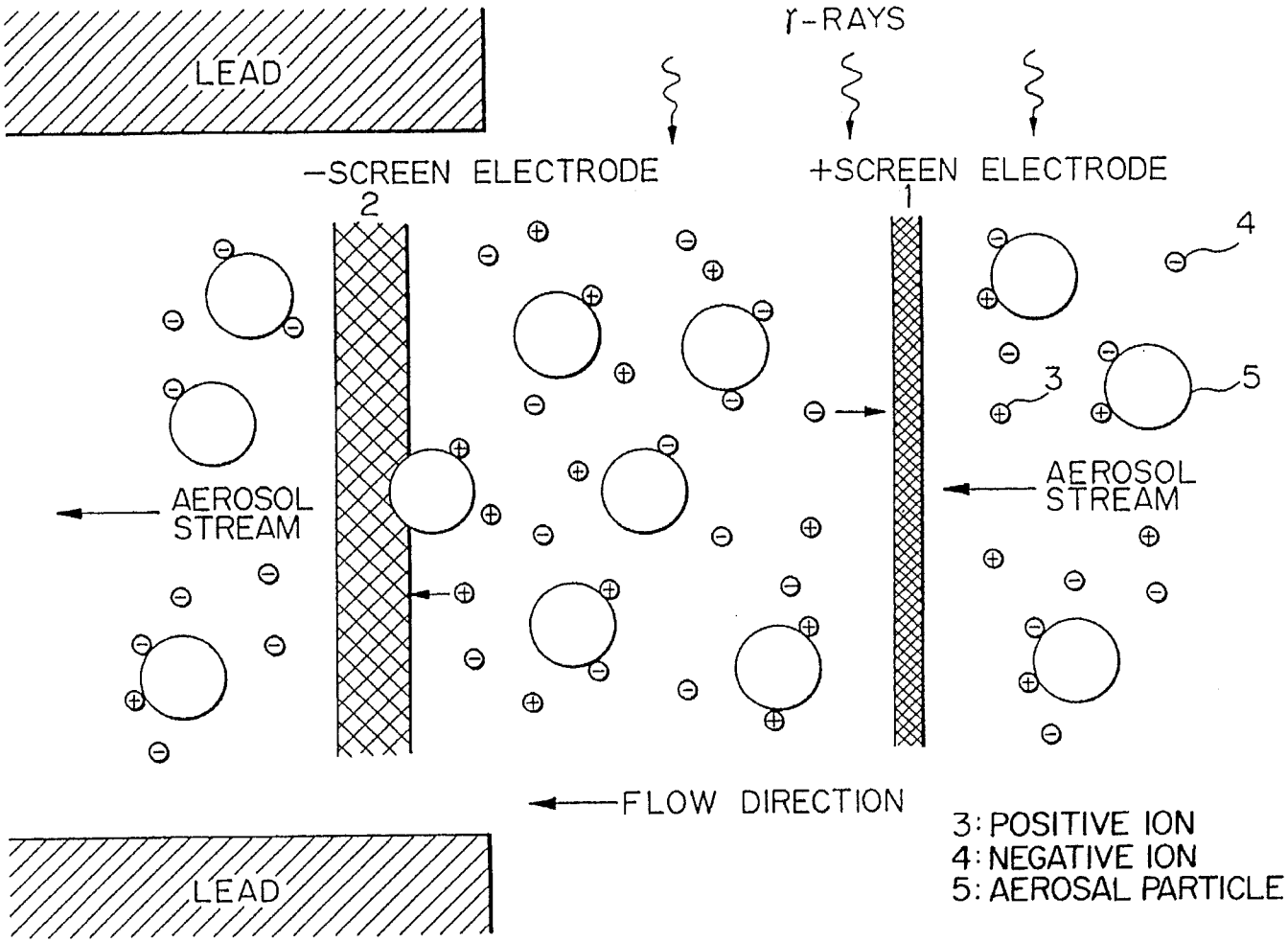
FIG. 1 is a diagram illustrating how aerosol particles are electrified under exposure to gamma-rays.

The operating principle of the present invention is described below with reference to FIG. 1. A screen electrode 1 under exposure to gamma-rays or beta particles due to bombardment by electron beams is spaced from a screen electrode 2 shielded from radiations. With a weak dc current being applied between the two electrodes, an aerosol-containing ambient gas is admitted to flow from the exposed electrode 1 to the shielded electrode 2. The current flowing in the space between the two electrodes (the space may be referred to as a "cell for electrification to a single polarity") is due to the streams of positive ions 3 and negative ions 4 produced by ionization with the radiation and this current, generally called "saturation current", is essentially different from the field current which flows in a strong electric field.

The positive and negative ions produced by ionization with the radiation collide with aerosol particles 5 due to Brownian motion within the cell for electrification to a single polarity, whereby a charged aerosol is created. This aerosol consisting of both positively and negatively charged particles is passed through the shielded electrode 2 under the force of the stream. Since the electrode 2 is shielded from radiations, the charged aerosol in the area around the electrode 2 will not be neutralized with the applied radiation.

As a result of the passage of the charged aerosol through the shielded electrode 2, positive particles are deposited on the surface of the electrode 2 if its polarity is negative whereas negative particles are deposited if the polarity is positive. Uncharged particles or the particles neutralized with the applied radiation will not deposit on the electrode 2 but will simply pass through it. Since the aerosol-containing ambient gas passing through the electrode 2 contains large volumes of ions that have been electrified to the same single polarity as the electrode 2, the aerosol particles will collide with those monopolar ions to become charged either positively or negatively. The aerosol particles thusly electrified to a single polarity are deposited on the surface of a certain substance under the strong image force (electrostatic force); what is more, they may be admitted into a HEPA filter with a marked improvement achieved as for the trapping efficiency.

Figure 2:
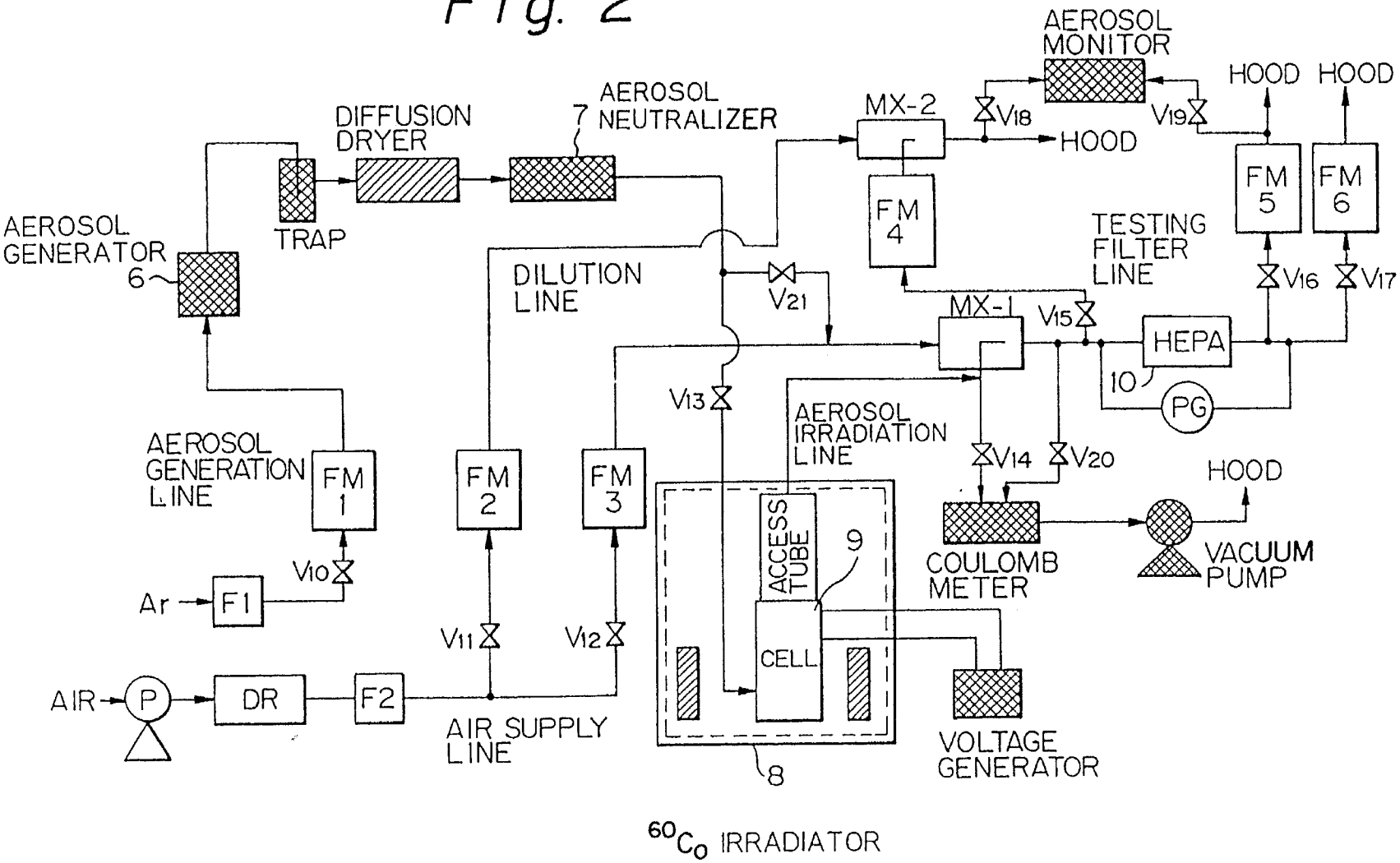
FIG. 2 is a flowsheet of a system for electrifying aerosol particles to be charged to a single polarity.

A flowsheet for the system to implement the method of the present invention is described below with reference to FIG. 2. In the system shown in FIG. 2, DOP (dioctyl phthalate) which is easy to form an aerosol is supplied to an aerosol generator 6 by means of a metering syringe-type pump. Within the aerosol generator 6, DOP is atomized with high-purity argon to form an aerosol.

The particles In the aerosol that are larger than 1 μm are trapped and only the smaller particles are sent to subsequent stages. Since the aerosol may have potentially been electrified, it is passed through a $^{85}$Kr aerosol neutralizer (2 mCl)

7 to neutralize the charges on the aerosol particles before they are admitted into a cell 9 for electrification to a single polarity that is mounted within a $^{60}Co$ irradiator 8. The cell 9 contains a cylindrical screen electrode and a rod-shaped screen electrode. The area around the cylindrical screen electrode is exposed to gamma-rays but the rod-shaped screen electrode is surrounded by lead that provides a shield from radiations. A weak dc voltage is applied between the two electrodes to produce a saturation current of a value that is determined by the intensity of the applied gamma-rays.

The aerosol enters the cell from the bottom and passes through the rod-shaped screen electrode in the upper part to enter a mixer (MX-1). After being diluted with a large volume of air in the mixer, the aerosol is admitted into a HEPA filter 10. The aerosol upstream of the filter is further diluted for counting the number of particles. The number of submicron (0.065–1.0 μm) aerosol particles is counted with a laser operated light scattering aerosol monitor that is provided not only at the entrance to and exit from the cell for electrification to a single polarity but also upstream and downstream of the HEPA filter.

The following example is provided for the purpose of further illustrating the present invention but should in no way be taken as limiting.

EXAMPLE

Figure 3:
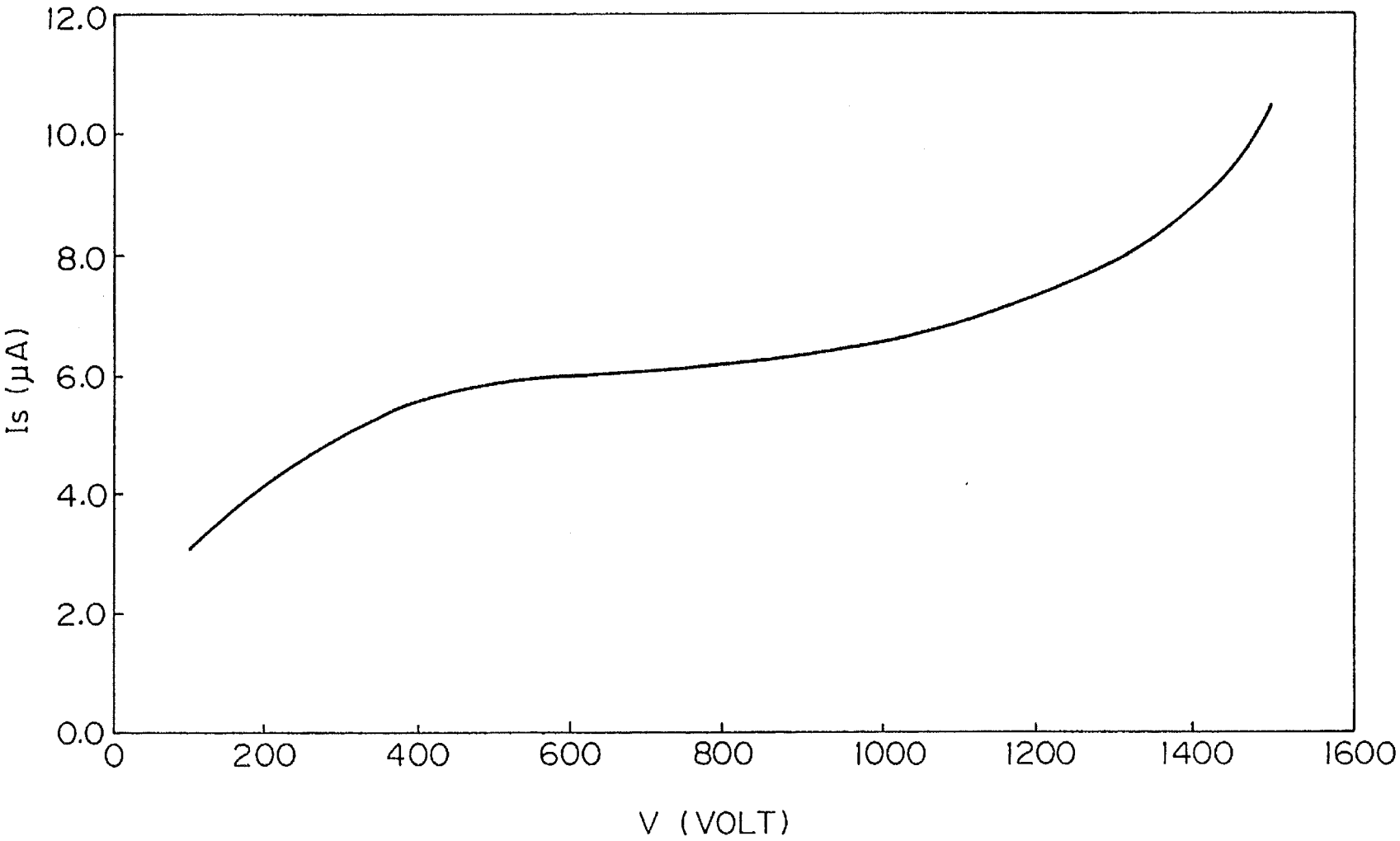
FIG. 3 is a graph showing the relationship between saturation current and voltage of the cell (i.e., plateau characteristic)

In the example, DOP was supplied into the aerosol generator by means of the metering syringe-type pump and DOP was atomized with high-purity argon in the aerosol generator. The DOP aerosol entered the cell for electrification to a single polarity that was installed within the $^{60}Co$ irradiator and the aerosol in the cell was exposed to gamma-rays. A dc voltage of 1000 V was applied between the electrodes in the cell, whereupon a saturation current depending on the intensity of the applied gamma-rays started to flow. FIG. 3 shows the profile of saturation current vs voltage. The charged aerosol passing through the cell for electrification to a single polarity was diluted with a large volume of air before it was admitted into the HEPA filter.

Figure 4:
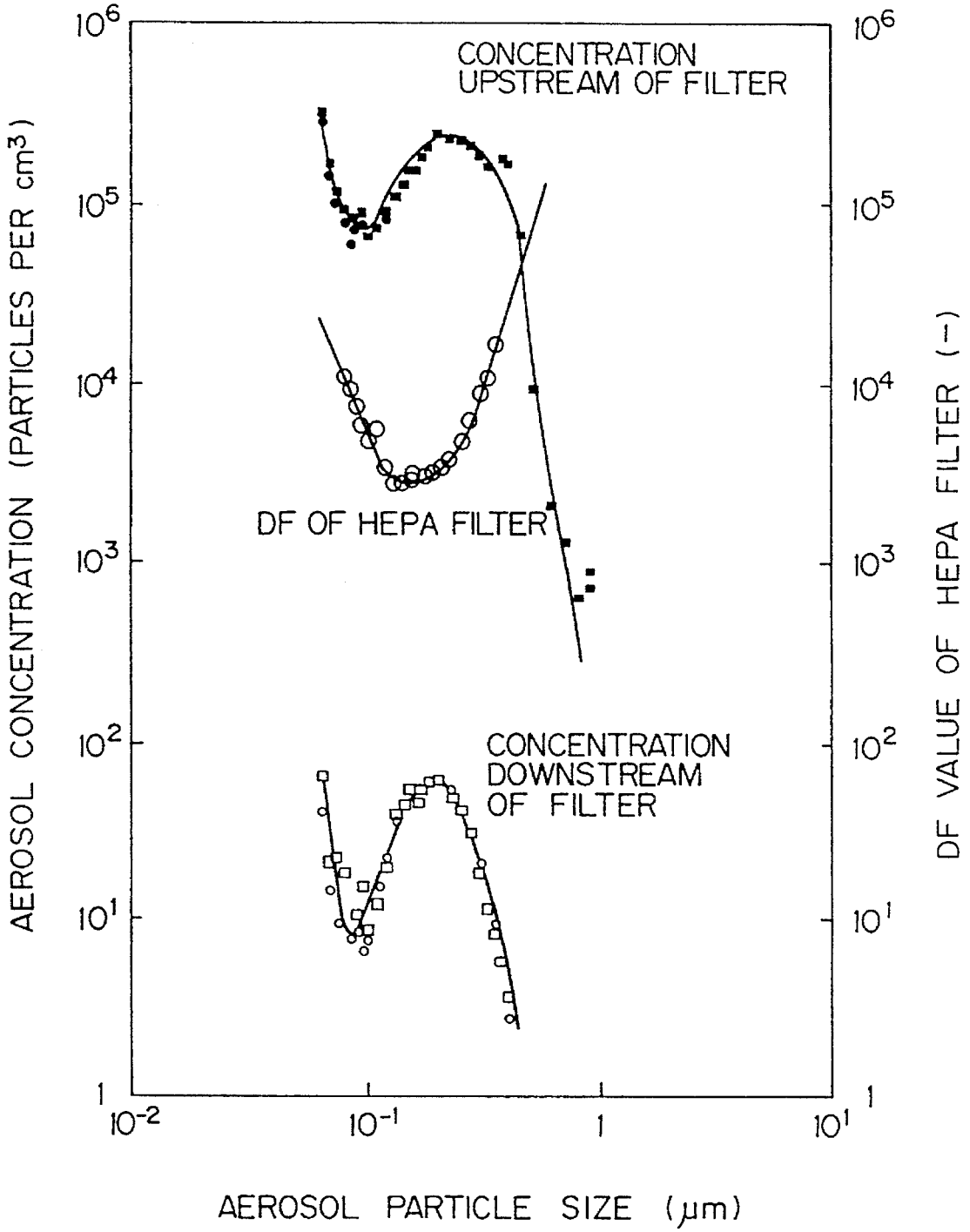
FIG. 4 is a graph showing the profiles of aerosol concentration both upstream and downstream of a HEPA filter, as well as the DF value of the filter, which is the ratio of number concentrations of aerosol before and after the filter (voltage=0 V; without exposure to gamma-rays)

FIG. 4 shows the particle size distributions of aerosol both upstream and downstream of the HEPA filter under ordinary conditions in the absence of applied gamma-rays and electric field. Also shown in FIG. 4 are the filter's DF data (the ratio of the particulate count upstream of the filter to tile particulate count downstream of the filter). The HEPA filter operating under ordinary conditions will usually have DF values of about $10^3$ at minimum value.

Figure 5:
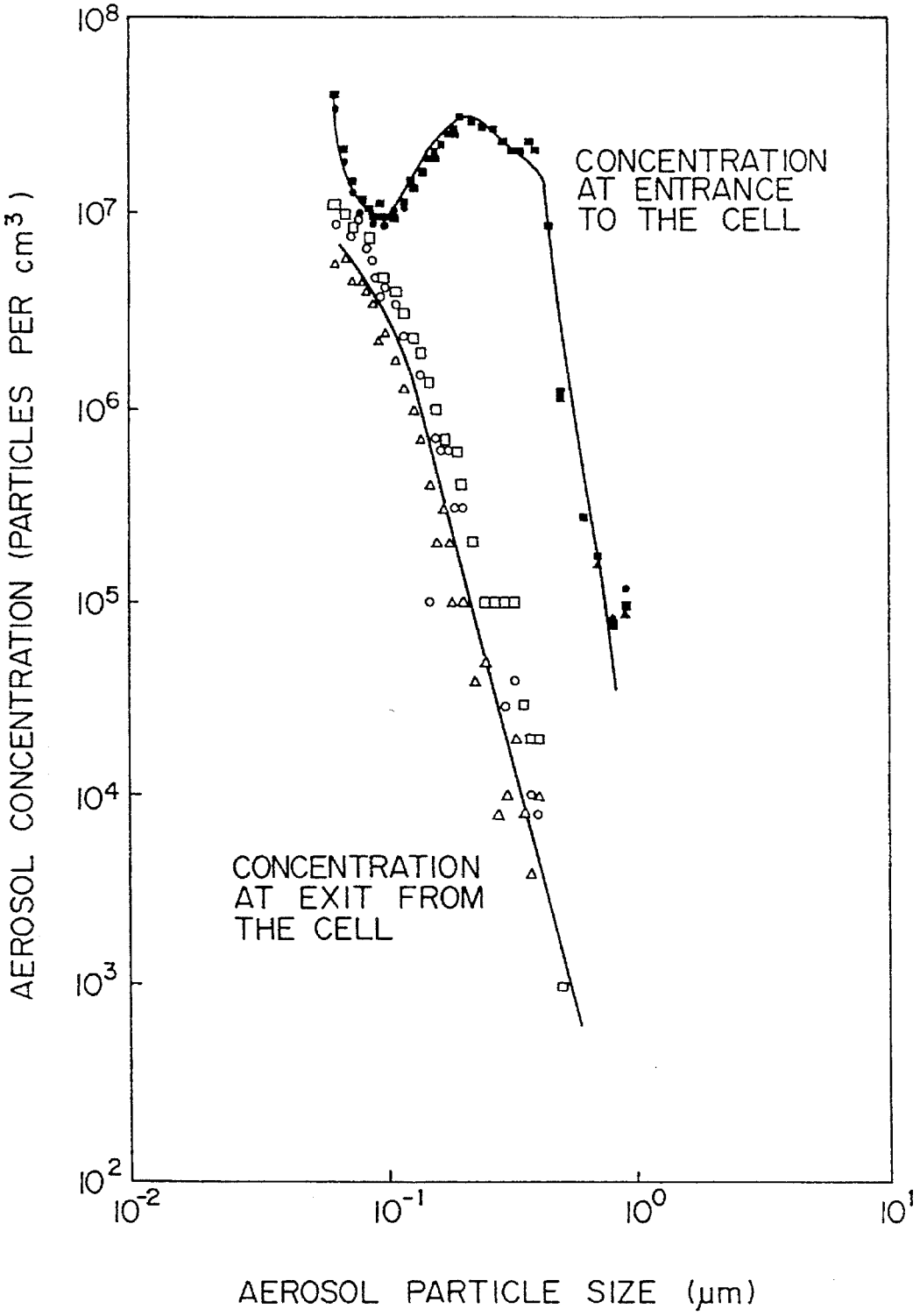
FIG. 5 is a graph showing the concentration profile of uncharged particles in aerosol at the entrance to the cell for electrification to a single polarity, as well as the concentration profile of negatively charged particles in aerosol at the exit from the cell.

FIG. 5 shows the particle size distributions of aerosol both at the entrance to and exit from the cell for electrification to a single polarity, with a negative potential being applied to the rod-shaped electrode (so that a negatively charged aerosol would flow out) under exposure to gamma-rays. When a negatively charged aerosol flowed out, positively charged aerosol particles deposited extensively within the cell (on the rod-shaped electrode).

Figure 6:
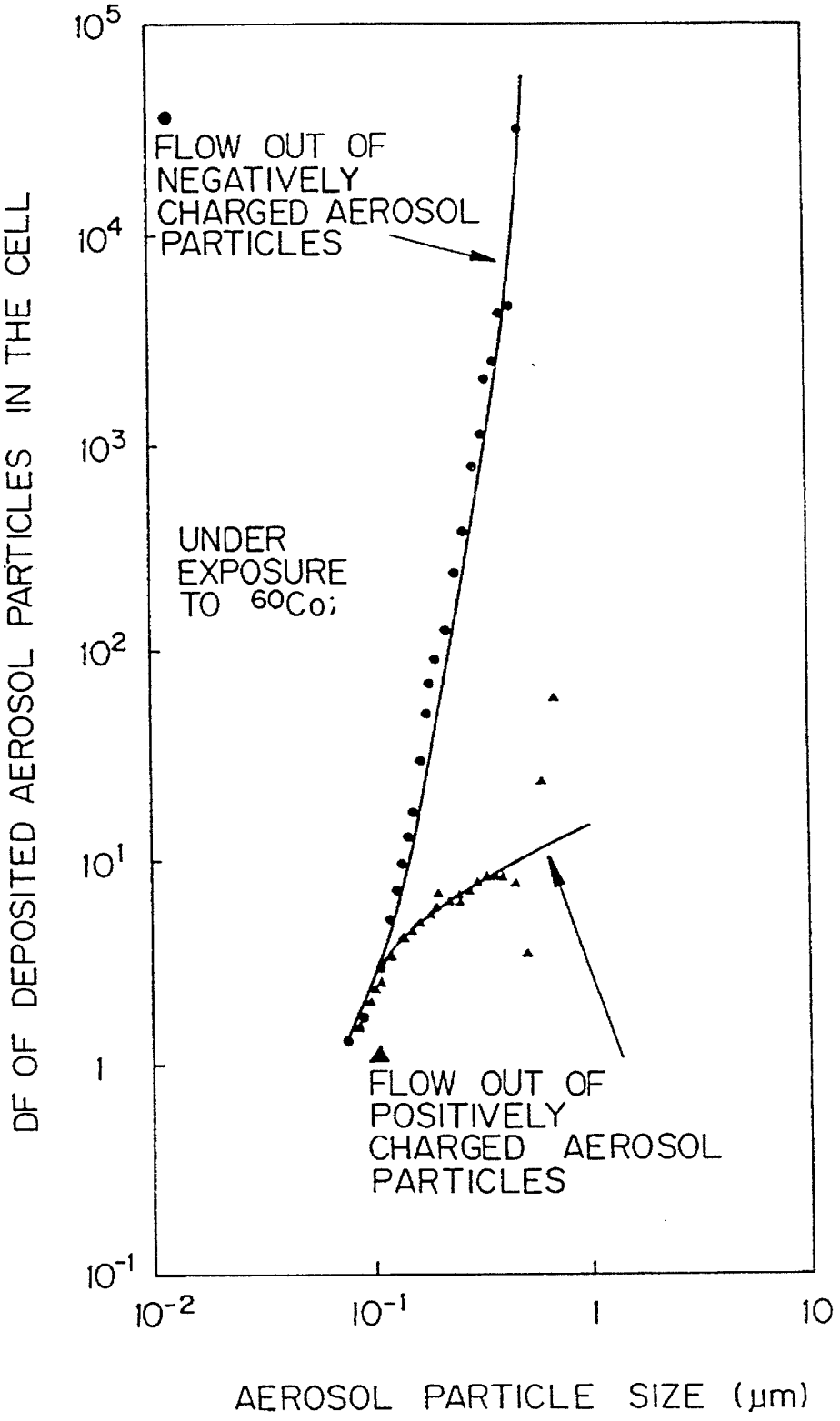
FIG. 6 is a graph plotting the DF curves for the deposits of negatively charged aerosol particles and positively charged particles on the electrodes within the cell for electrification to a single polarity under exposure to $^{60}$Co.

FIG. 6 shows the DF data for the flow out of positively charged aerosol particles ▲) and negatively charged particles (●). Negatively charged aerosol particles with sizes of 0.4 μm and more had DF values in excess of $10^3$, which were greater than the DF value of the HEPA filter.

Figure 7:
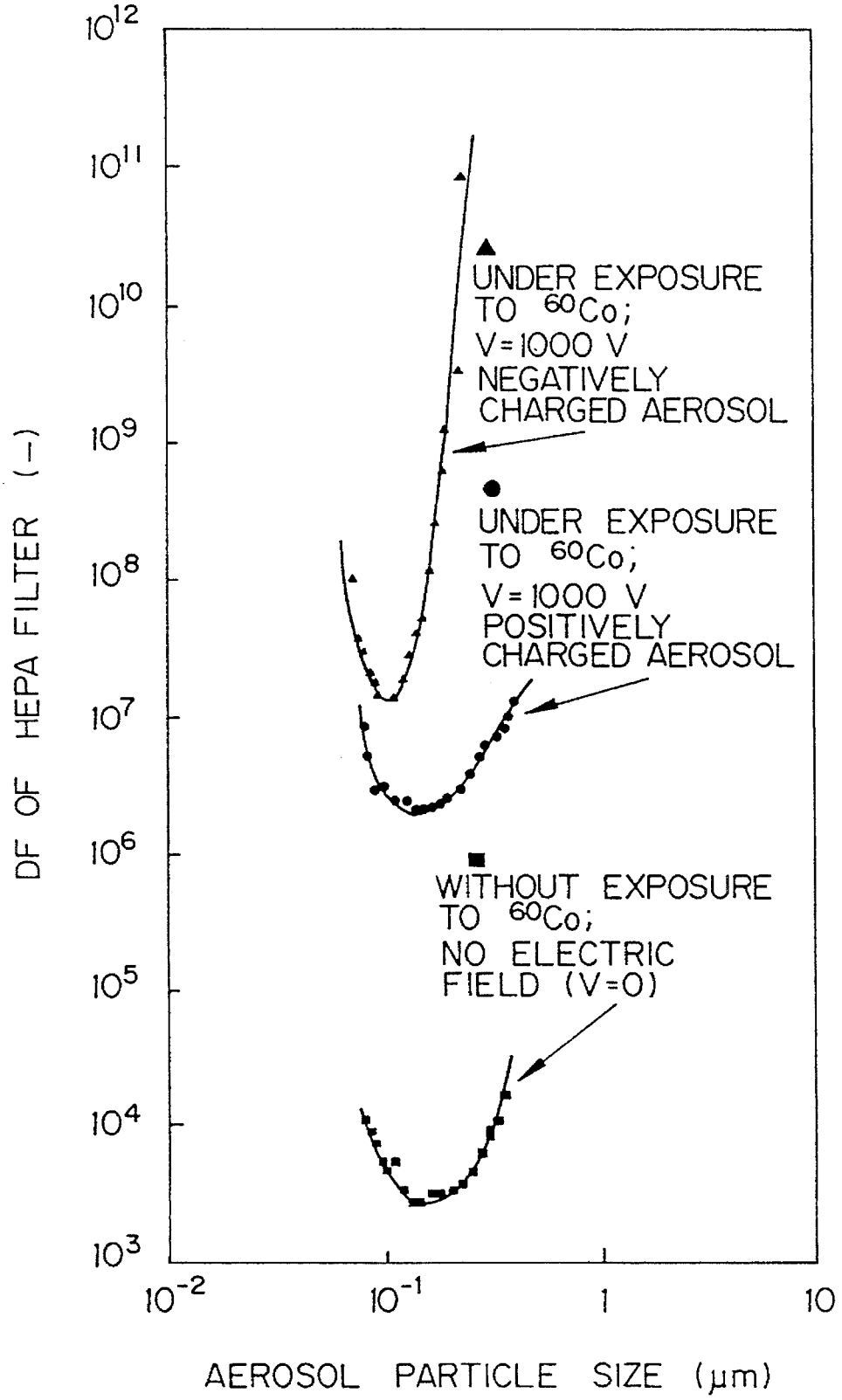
FIG. 7 is a graph showing the overall DF values of charged aerosol particles using the system in FIG. 2.

FIG. 7 shows tile overall DF values of two types of monopolar aerosol particles the first being charged positively and the second negatively. The term "overall DF value" as used herein is defined as the ratio of the number of particles in an aerosol before it enters the $^{60}Co$ irradiator to the number of particles in a charged aerosol that was passed through the HEPA filter after irradiation with $^{60}Co$. The ordinary HEPA filter had DF values on the order of $10^3$ (■); in contrast, the positively charged aerosol particles had higher DF values on the order of $10^6$ (●) and the negatively charged aerosol particles had even higher DF values on the order of $10^7$ (▲).

In the present invention, an aerosol-containing ambient gas is exposed to a radiation so that it is ionized to produce Ionic pairs consisting of positive and negative ions and either positive or negative species are caused to act on the aerosol, whereby the aerosol particles are charged to a single polarity. The thusly charged aerosol particles are deposited or trapped for very efficient removal.

What is claimed is:

1. A method of removing aerosol particles from an aerosol-containing gas, comprising:

(a) applying a dc current in a cell between a porous electrode exposed to radiation and a porous electrode shielded from radiation;

(b) allowing the aerosol-containing gas to flow in the cell from the exposed electrode to the shielded electrode and exposing the gas to radiation so that streams of positive and negative ions are formed by radiation-induced ionization;

(c) causing the positive and negative ions to collide with the aerosol particles in the cell to form charged aerosol particles;

(d) subsequently passing the charged aerosol particles through the shielded electrode so that the aerosol particles electrified with positive ions are deposited or trapped on the shielded electrode if the latter has a negative polarity or that the aerosol particles electrified with negative ions are deposited or trapped on the shielded electrode if the latter has a positive polarity;

(e) thereby generating charged aerosol particles of a single polarity in the area just downstream of the shielded electrode as a result of collisions with large quantities of ions that have been electrified to the same single polarity as that of the shielded electrode; and (f) then either depositing the charged aerosol particles of a single polarity on the surface of a substance by an electrostatic force or trapping the charged aerosol particles of a single polarity on an electrode or a filter.

* * * * *